US005605182A

United States Patent [19]

Oberrecht et al.

[11] Patent Number: 5,605,182

[45] Date of Patent: Feb. 25, 1997

[54] VEHICLE IDENTIFICATION SYSTEM FOR A FUEL DISPENSER

[75] Inventors: David Oberrecht; Stephen J. Stephenson, both of Cincinnati; Sean Scott, Springboro; Curtis E. Frederick, Maineville; Jonathan P. Young, West Chester, all of Ohio

[73] Assignee: Dover Corporation, New York, N.Y.

[21] Appl. No.: 425,099

[22] Filed: Apr. 20, 1995

[51] Int. Cl.[6] ..... B67D 5/01

[52] U.S. Cl. ..... 141/94; 141/351; 141/231; 141/98; 340/825.34; 340/825.35

[58] Field of Search ..... 141/94, 98, 219, 141/231, 351, 360, 361; 364/465; 340/825.34, 825.35, 364

[56] References Cited

U.S. PATENT DOCUMENTS

| | | | |
|---|---|---|---|
| 3,642,036 | 2/1972 | Ginsburgh et al. . | |
| 3,650,303 | 3/1972 | Chambers et al. . | |
| 3,670,303 | 6/1972 | Dame . | |
| 3,689,885 | 9/1972 | Kaplan et al. . | |
| 3,720,911 | 3/1973 | Bomer, Jr. . | |
| 3,742,150 | 6/1973 | Sherman et al. . | |
| 3,786,421 | 1/1974 | Wostl et al. . | |
| 3,814,148 | 6/1974 | Wostl . | |
| 3,816,708 | 6/1974 | Walton . | |
| 4,067,061 | 1/1978 | Juhasz | 364/900 |
| 4,074,356 | 2/1978 | Schiller et al. . | |
| 4,107,777 | 8/1978 | Pearson et al. . | |
| 4,109,686 | 8/1978 | Phillips . | |
| 4,186,381 | 1/1980 | Fleischer et al. . | |
| 4,250,550 | 2/1981 | Fleischer . | |
| 4,258,421 | 3/1981 | Juhasz et al. | 364/424 |
| 4,263,945 | 4/1981 | Van Ness | 141/98 |
| 4,313,168 | 1/1982 | Stephens et al. . | |
| 4,344,136 | 8/1982 | Panik . | |
| 4,345,146 | 8/1982 | Story et al. | 235/381 |
| 4,360,877 | 11/1982 | Langston et al. . | |

(List continued on next page.)

OTHER PUBLICATIONS

The Smartlok System, Civacon, 1994.

Tiris Fleet Management, Texas Instruments.

*Electronic Identification and Vehicle Register System.* The Most Advanced Technology Applied to Combustible Dispatching. (English Translation) Aug. 28, 1995).

Programmed Computer Controlled Gas Station. IBM Technical Disclosure Bulletin, vol. 21, No. 7, (Dec., 1978).

POS Terminal for Gas Stations., National Technical Report, vol. 26, No. 4 (Aug. 1980).

Microcompter Controls Petrol Pump Operation., Design Engineering (Apr. 1978).

*Primary Examiner*—J. Casimer Jacyna

*Attorney, Agent, or Firm*—Dinsmore & Shohl

[57] ABSTRACT

A vehicle identification system for use in a refueling station for identifying vehicle requirements, in which a control unit is located in a fuel dispenser for controlling functions of the dispenser such as fuel selection and activation of the dispenser's vapor recovery systems, and a driver circuit is located on the nozzle spout. The control unit communicates with the driver circuit through an intrinsically safe connection in a fuel hose and is programmed to periodically transmit a low power pulse signal to the driver circuit through this connection. The driver circuit includes a power generating means and an antenna for generating an RF interrogation signal in response to each pulse. The RF interrogation signal is detected by a transponder disposed on a vehicle adjacent the vehicle's fill pipe, when the nozzle is positioned adjacent to or in the fill pipe for refueling. The RF interrogation signal energizes the transponder to transmit a return signal containing vehicle identification codes accessed from a memory storage means in the transponder. These identification codes identify vehicle requirements, such as for example, fuel type. The driver circuit further includes a filter for detecting the identification signal from the transponder, and transmitting the signal to the control unit. The control unit interprets the vehicle identification codes and generates signals to control the dispenser in accordance with the vehicle requirements.

16 Claims, 5 Drawing Sheets

U.S. PATENT DOCUMENTS

| | | | |
|---|---|---|---|
| 4,469,149 | 9/1984 | Walkey et al. | 141/94 |
| 4,473,825 | 9/1984 | Walton . | |
| 4,482,964 | 11/1984 | Berstein et al. . | |
| 4,485,783 | 12/1984 | Gruden | 123/406 |
| 4,490,798 | 12/1984 | Franks et al. . | |
| 4,510,495 | 4/1985 | Sigrimis et al. . | |
| 4,532,511 | 7/1985 | Lemelson . | |
| 4,551,719 | 11/1985 | Carlin et al. . | |
| 4,563,739 | 1/1986 | Gerpheide et al. . | |
| 4,600,829 | 7/1986 | Walton . | |
| 4,627,553 | 12/1986 | Yoshida et al. . | |
| 4,630,044 | 12/1986 | Polzer . | |
| 4,630,292 | 12/1986 | Juricich et al. . | |
| 4,658,371 | 4/1987 | Walsh et al. . | |
| 4,714,925 | 12/1987 | Bartlett | 340/825.55 |
| 4,750,130 | 6/1988 | Shimamura et al. . | |
| 4,752,899 | 6/1988 | Newman et al. . | |
| 4,804,937 | 2/1989 | Barbiaux et al. . | |
| 4,837,556 | 6/1989 | Matshushita . | |
| 4,839,854 | 6/1989 | Sakami et al. . | |
| 4,846,233 | 7/1989 | Fockens | 141/94 |
| 4,853,859 | 8/1989 | Morita et al. . | |
| 4,897,642 | 1/1990 | DiLullo et al. | 340/825.06 |
| 4,911,217 | 3/1990 | Dunn et al. . | |
| 4,926,331 | 5/1990 | Windle et al. . | |
| 4,926,494 | 5/1990 | Potter | 455/41 |
| 4,929,818 | 5/1990 | Bradbury . | |
| 4,934,419 | 6/1990 | Lamont et al. | 141/94 |
| 4,967,366 | 10/1990 | Kaehler . | |
| 5,025,253 | 6/1991 | DiLullo et al. | 340/825.06 |
| 5,058,044 | 10/1991 | Stewart et al. . | |
| 5,070,328 | 12/1991 | Fockens | 340/825.54 |
| 5,070,535 | 12/1991 | Hochmair et al. . | |
| 5,072,380 | 12/1991 | Randelman et al. . | |
| 5,073,781 | 12/1991 | Stickelbrocks | 342/51 |
| 5,086,389 | 2/1992 | Hassett et al. . | |
| 5,156,198 | 10/1992 | Hall . | |
| 5,157,433 | 10/1992 | Suzuki et al. | 356/128 |
| 5,181,975 | 1/1993 | Pollack et al. | 152/152.1 |
| 5,198,807 | 3/1993 | Troyk et al. | 340/825.54 |
| 5,204,819 | 4/1993 | Ryan | 364/465 |
| 5,218,861 | 6/1993 | Brown et al. | 73/146.5 |
| 5,249,612 | 10/1993 | Parks et al. | 141/219 |
| 5,294,931 | 3/1994 | Meier | 324/44 |
| 5,359,522 | 10/1994 | Ryan | 364/465 |

VEHICLE IDENTIFICATION SYSTEM FOR A FUEL DISPENSER

TECHNICAL FIELD

The present invention relates to a vehicle identification system for a refueling station for use in determining vehicle operating characteristics, and more particularly, to a vehicle identification system in which a control means on a fuel dispenser interrogates a transponder on a vehicle prior to refueling to obtain operating codes for the vehicle for use in properly configuring the dispenser.

BACKGROUND OF THE INVENTION

In recent years, a great deal of public attention has been focused upon the environmental effects of the use of fossil fuels, such as gasoline, in automobiles and other vehicles. This attention has focused in part on the effects the vapors produced by these fuels have on the environment, and in part on the vehicle emissions produced by the burning of these fuels. To reduce these fuels' harmful environmental effects, new environmental standards have been implemented. These standards have included the Clean Air Act of 1990 which mandated the use of vacuum-assisted (VA) vapor recovery systems at retail gasoline facilities. In VA systems, means are incorporated on the nozzle for recovering vapor from the vehicle fuel tank back to the underground fuel storage tank. In one widely employed vapor recovery system, a bellows is telescoped over a nozzle spout to form a coaxial vapor return passage in combination with the nozzle spout. The free end of the bellows sealingly engages the fuel fill pipe so that vapor displaced from the tank is captured in this passage. The vapor then passes, through the body of the nozzle, to a coaxial hose. The coaxial hose has an inner hose through which fuel passes and an outer, coaxial, spaced hose which defines a vapor passage through which the fuel vapor passes to the dispenser and then back to the storage tank. To date, VA systems have been widely implemented at retail gasoline facilities, and it is estimated that up to 700,000 hose point systems could be in place by the year 2000.

More recently, additional legislation has mandated that On Board Refueling Vapor Recovery systems or "ORVRs" be implemented on all new automobiles and light trucks beginning in the year 1998. In an ORVR system, a carbon canister is installed on the vehicle to absorb the vapors produced during refueling. These ORVR systems are intended to replace the existing VA vapor recovery systems and increase the ability to recover vapors which are normally produced during vehicle refueling at a pump or dispenser. With the impending transition from vacuum-assisted systems to ORVR's, several key technical issues have emerged. At the forefront of these issues is the incompatibility of the current vacuum-assisted vapor recovery system and the proposed ORVR systems. If development work on the ORVR systems continues in its current direction, a liquid seal in the auto fillpipe will direct fuel tank vapors to the on-board canister in the vehicle. In the case of a dispenser with a VA system refueling an ORVR equipped vehicle, the VA system will ingest fresh air at the nozzle and pump the air back to the underground storage tank. This fresh air will saturate in the underground storage tank, causing gasoline vapor growth and a pressure increase in the tank, to the point of opening the pressure vacuum vent. When this happens, fugitive emissions are created, partially offsetting the benefits derived from collecting the refueling vapors in the on-board canister.

Accordingly, in the future, as vehicles begin to be produced with on-board canisters, it will be necessary to have a system for determining at the refueling point, whether a vehicle has been equipped with an onboard canister. If the vehicle does have an onboard canister or ORVR, the dispenser VA system could be shut-off during the refueling operation to prevent fresh air from being ingested into the system. Likewise, if the vehicle is not equipped with an ORVR, the dispenser VA system could be made operative to capture vapors during fueling.

Another "environmentally friendly" alternative that has been proposed to reduce smog producing VOC emissions is the use of alternative fuels. Methanol is a leading alternative fuel contender at this time, because it produces lower emissions than traditional gasoline. However, a key issue surrounding the widespread adoption of alternative fuels is how to properly identify methanol fueled vehicles at the refueling point to prevent accidental misfueling of a vehicle. An improper identification of a vehicle's fuel can result in the vehicle being rendered inoperable. Accordingly, it is essential to have an accurate and reliable system for determining vehicle fuel requirements. Solutions that have been proposed in the past to solve the problem of identifying methanol vehicles have included unique nozzle spout shapes and card/key lock systems to authorize refueling. However, these applications have proven to be impractical to implement on a wide scale. Accordingly, it is desirable to have a practical, convenient system for identifying alternative vehicles that is capable of being implemented on a wide scale basis.

RF identification systems have been provided in the past which have enabled a base station to interrogate any of a number of vehicles in a fleet in order to obtain vehicle and operator information. However, up until now, it has not been possible to utilize these systems in refueling stations due to safety concerns. According to prior systems, in order to generate an RF signal to interrogate a vehicle, a high power signal would need to be transmitted to the nozzle through the fuel hose. Due to the highly flammable nature of the fuel and vapor passing through the hose, this high power signal would create an unreasonable risk of fire, and hence, render the system too dangerous for use.

Thus, a need exists for a vehicle identification system which can be used to identify alternative fuel vehicles and obtain other vehicle information, yet which is safe for use in a vehicle refueling station.

SUMMARY OF THE INVENTION

Accordingly, it is a principal object of the present invention to provide a system for identifying vehicle operating characteristics at a fuel dispenser.

In particular, it is an object of the present invention to provide a vehicle identification system for use at a refueling station in which a fuel dispenser, by means of an antenna on the nozzle spout, interrogates a vehicle prior to refueling for vehicle operating information, and properly configures the pump based upon the received information.

Another object of the present invention is to provide a vehicle identification system which is intrinsically safe and can be used in a highly flammable environment such as a fuel station.

Yet another object of the present invention is to provide an identification system which can accurately obtain vehicle information regardless of the vehicle's location at the fuel dispenser.

Yet another object is to provide a means for generating a high power signal from a low power digital pulse transmitted from a remote controlling circuit.

Still another object is to provide a system for quickly and accurately configuring an environmental control device on a fuel dispenser.

Additional objects, advantages and other novel features of the invention will be set forth in part in the description that follows and, in part, will become apparent to those skilled in the art upon examination of the invention. The objects and advantages of the invention may be realized and obtained by means of the instrumentalities and combinations particularly pointed out in the appended claims.

To achieve the foregoing and other objects, and in accordance with the purposes of the present invention as described above, a vehicle identification system is provided in which a control means is located in a fuel dispenser island for controlling various functions including fuel selection and activation of vapor recovery systems. Individual dispensers on the island are connected by flexible hoses to nozzles, for dispensing fuel to vehicles. In addition, a driver circuit including an antenna means is attached adjacent to the ends of each nozzle. The control means alternately communicates with each of the driver circuits through intrinsically safe connections in each fuel hose, and is programmed to periodically transmit a low power pulse signal via a cable to the driver circuit through this connection. The intrinsically safe connection between the sensor and driver circuit assures that only low power signals are transmitted through the fuel hose to eliminate the risk of sparking and fire. Each driver circuit includes a power generating means and an antenna for broadcasting an RF interrogation signal in response to each pulse.

The RF interrogation signal is detected by a transponder disposed on a vehicle adjacent the vehicle's fill pipe, when the nozzle is positioned adjacent to or in the fill pipe for refueling. The RF interrogation signal energizes the transponder to transmit a return signal containing vehicle identification codes accessed from a memory storage means in the transponder. These identification codes specify vehicle requirements, such as fuel type.

The driver circuit further includes means for detecting the identification signal from the transponder, and transmitting the signal to the control means for the dispenser. The control means interprets the vehicle identification codes in the signal, and generates control signals to operate the dispenser in accordance with the vehicle requirements.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different, obvious aspects all without departing from the invention. Accordingly, the drawings and description should be regarded as illustrative in nature and not as restrictive.

DETAILED DESCRIPTION OF THE PREFERRED EMBODIMENT

Figure 1:
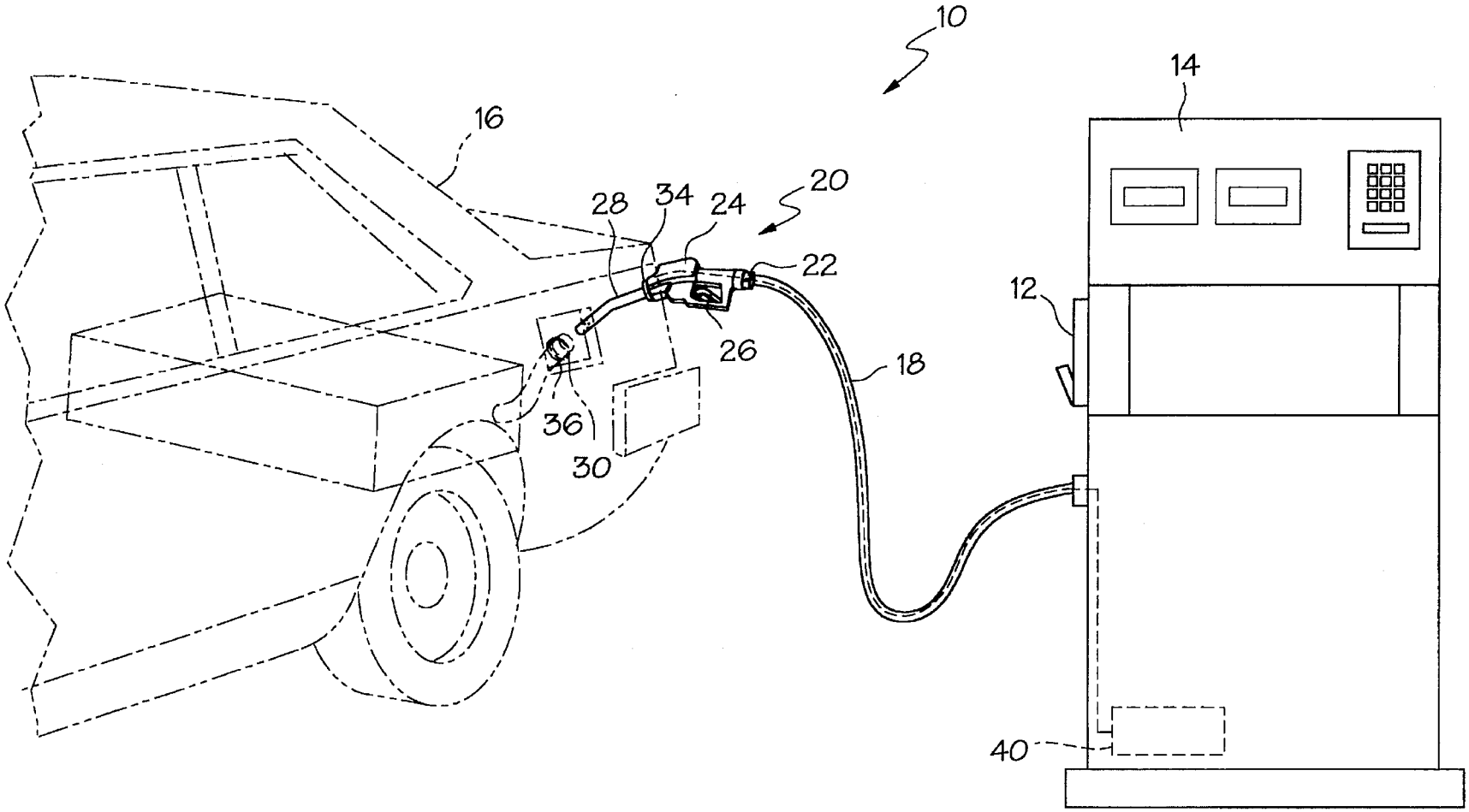
FIG. 1 is a perspective view showing an embodiment of the present invention at a vehicle refueling station.

Referring now to the drawings, FIG. 1 is a simplified illustration of a fuel station, generally designated as 10, depicting a single dispenser 12 at an island 14, and a vehicle 16 positioned at the dispenser. Though only a single island and dispenser is shown in the drawings, it is to be understood that the present invention may be implemented at fuel stations having any number of islands, and dispensers per island, without departing from the scope of the invention. The dispenser 12 includes a fuel hose 18 with a nozzle 20 connected at a distal end thereof by an adaptor 22. As shown in more detail in FIG. 2, nozzle 20 includes a hand grip portion 24 having a lever 26 that is manually operable in a conventional manner to dispense fuel. At the distal end of the hand grip 24 is a nozzle spout 28. Nozzle spout 28 can be of conventional form, having a generally cylindrical shape that is sized to fit into a standard vehicle fill pipe, such as the fill pipe 30 illustrated in FIG. 1. Hand grip 24 also includes an interior passage, not shown, which is in communication with a passage in the nozzle spout 28 for conveying fuel from the hose 18, to the vehicle fill pipe 30.

Figure 2:
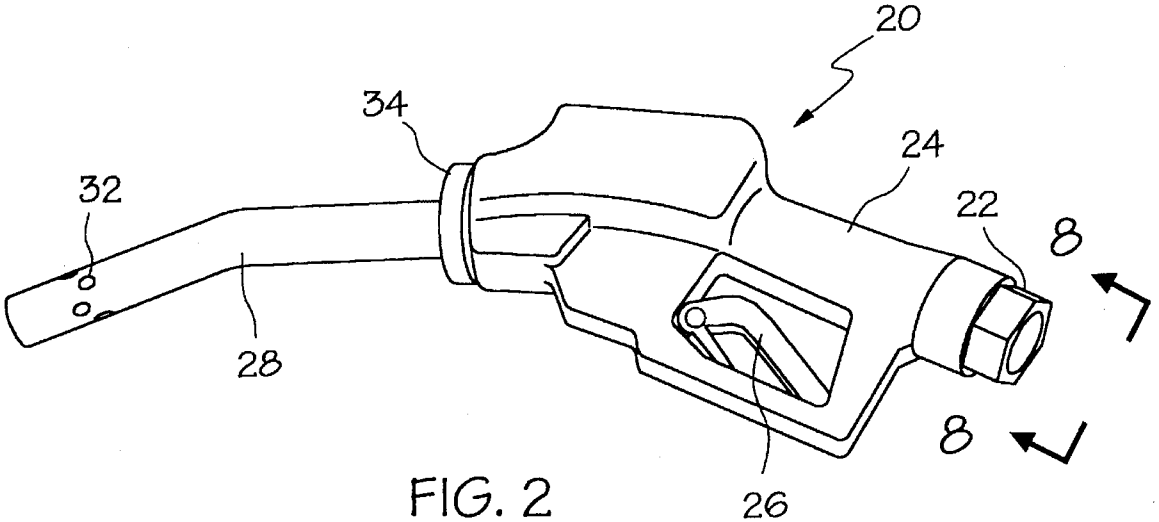
FIG. 2 is a perspective view of a fuel nozzle showing the antenna means of the present invention applied thereto.

As shown in more detail in FIG. 2, the nozzle spout 28 preferably includes openings 32 which are used in conjunction with a vacuum-assisted vapor recovery system, installed in the dispenser 12, to transmit vapors released during fueling back to an underground fuel storage tank (not shown), in order to prevent the vapors from being released into the environment. When a vapor recovery system is installed, the passage through the nozzle spout 28 will preferably be coaxial, to permit fuel to be dispensed into the vehicle through one passage while vapors are simultaneously being conveyed back to the underground storage tank.

As shown in FIGS. 1 and 2, an annular housing 34 is disposed coaxially on the spout 28, adjacent the grip 24. The housing 34 is preferably ring-shaped to enable the housing to be disposed circumferentially about the spout 28 and retained against the grip 24. The housing 34 is preferably comprised of a protective material such as plastic. A driver circuit and antenna are mounted inside of the housing, and the housing is filled in with an epoxy material to form an intrinsically safe barrier between the circuit and the outside atmosphere. The external leads for the driver circuit are also surrounded by an epoxy seal to prevent air gaps in the housing. The driver circuit and antenna will be described in more detail below.

Figure 7:
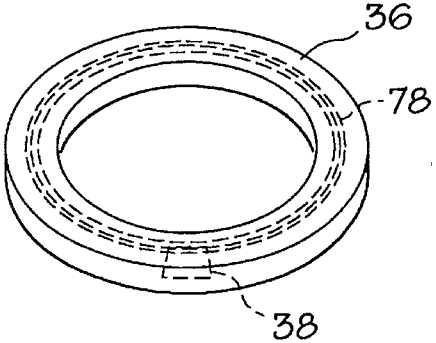
FIG. 7 Is a perspective view of the transponder of FIG. 4 encased in an annular housing for attachment to a vehicle.

As shown in FIGS. 1 and 7, in accordance with the system of the present invention, a second annular housing 36 is attached to vehicle 16, adjacent the vehicle fill pipe 30. This housing 36 is also preferably ring-shaped to enable the housing to be disposed circumferentially about the vehicle fill pipe 30 adjacent the distal end thereof, so as to be in close proximity to the nozzle 20, and particularly the nozzle spout 28, when the nozzle is placed into the fill pipe for vehicle refueling. Sealed in the interior of the housing 36 is a transponder 38 and antenna 78, which will be described in more detail below. While the embodiment shown in FIG. 1 depicts the housing 36 at the distal end of the fill pipe, it is to be understood that the housing could be placed in other locations on the vehicle, without departing from the scope of the invention, provided the transponder is within the broadcast range of the driver circuit antenna as will be described in more detail below.

Following is a description of the operational characteristics of the identification system of the present invention. In a preferred embodiment of the present invention, shown in FIG. 3, each island 14 preferably includes a controller circuit 40 with a microcontroller 42 incorporated therein for controlling the dispenser pumps and valves, as well as the dispenser VA systems. The microcontroller 42 can be an industry standard microcontroller such as the 8051 controller from Intel. The controller 40 is connected to the operative mechanisms for the dispensers 12 through an optocoupler 44 in a conventional manner for providing control signals to operate the dispenser. The optocoupler 44 enables the electronics in the present system to be isolated from the other working components in the dispensers. The controller 40 also includes sensor units 46 mounted in island 14. Preferably, each dispenser 12 on an island is associated with a single sensor 46, which controls the vehicle interrogation for that dispenser.

Figure 3:
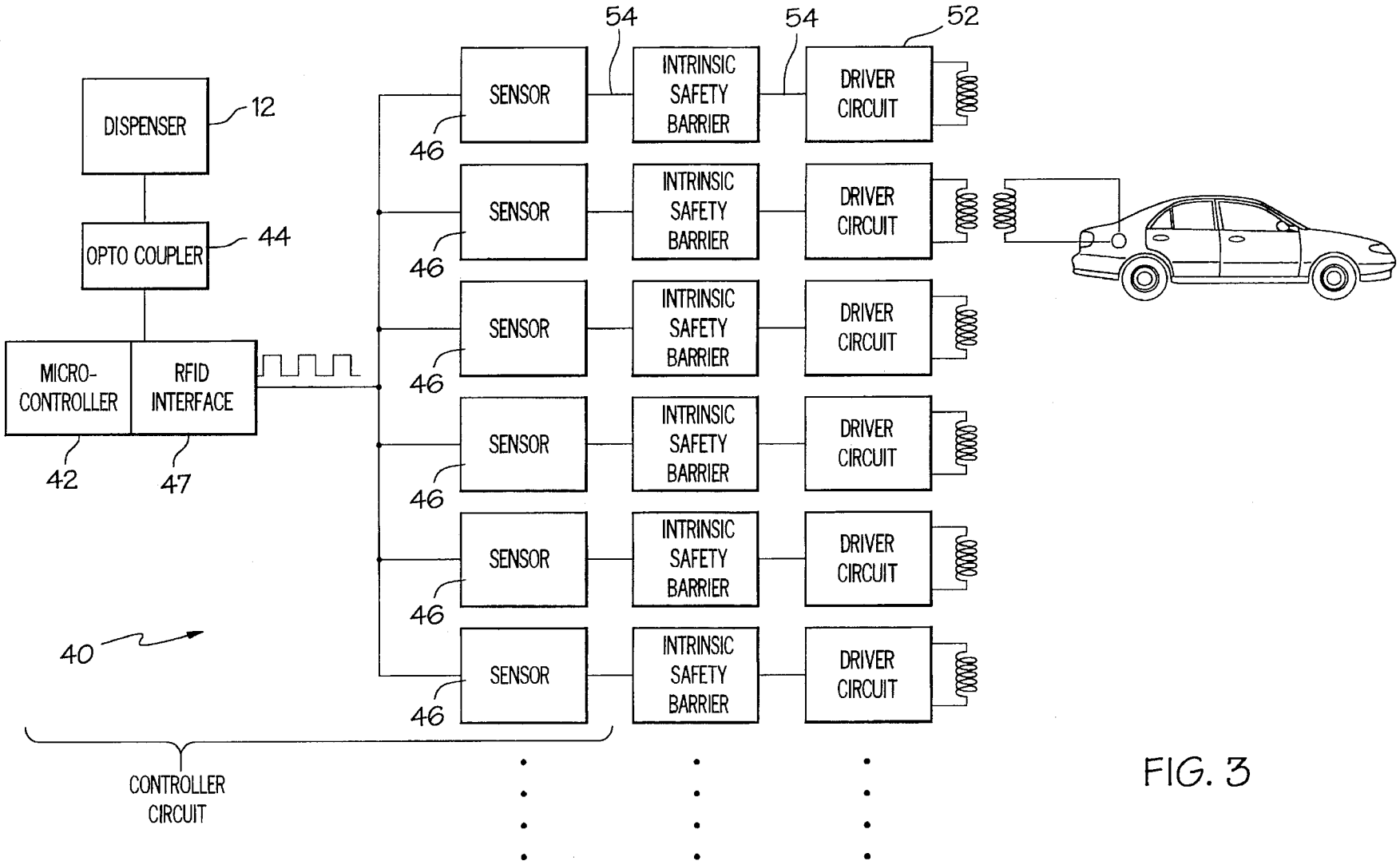
FIG. 3 is a block diagram of one embodiment of the electronics for the system of the present invention.

In a preferred embodiment of the present invention, the controller 40 further includes a RFID interface 47. The controller 40 controls the operation of the dispensers by periodically and cyclically generating enable pulses and transmitting the pulses to each of the sensors 46 in a known manner. In a preferred embodiment of the invention, the pulse period for the generator is approximately 150 milliseconds. Although there may be multiple dispensers associated with a particular island and controller as illustrated in FIG. 3, each of the dispensers operates in the same manner. Therefore, to simplify the description, the identification system of the present invention will be further described with respect to a single dispenser and nozzle.

Figure 4:
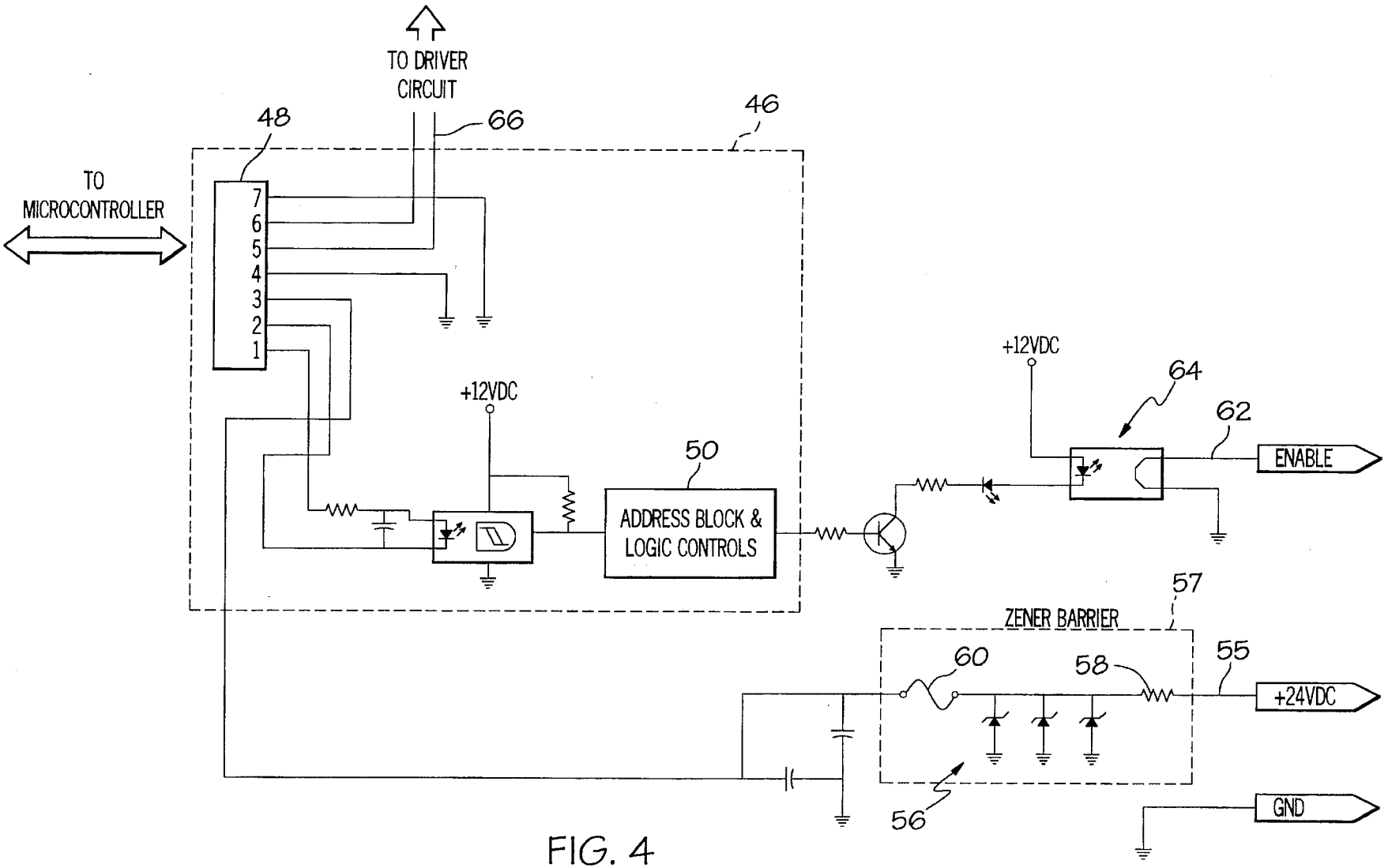
FIG. 4 is a partial schematic and partial block diagram of the sensor and intrinsic barrier circuits of FIG. 3.

As shown in FIG. 4, sensor 46 includes a terminal block 48 for receipt of the enable pulse signals and a power signal, and for transmitting identification signals to the microcontroller 42. In addition, sensor 46 includes an address block 50 containing a unique address for the sensor as well as logic controls for counting the pulses received from the interface 47 and comparing the pulse count to the sensor address. When the received pulse count equals the prestored address for the sensor 46, the sensor is powered on. Each of the sensors 46 connected to controller 40 has a unique address which corresponds to a particular pulse count in the pulse generator period, and each sensor is activated when its address equals the current count. In this manner, the system alternately activates each sensor in a predetermined order, in order to issue an interrogation signal and receive return identification signals for each of the nozzles in the island.

Once sensor 46 is activated, it generates an enable pulse in a standard manner for transmission to the driver circuit on the nozzle 20. Sensor 46 is connected to driver circuit 52 on the nozzle spout 28 via a cable 54 which extends through the interior of the fuel hose 18. It is preferable to extend cable 54 through the interior of the hose 18, rather than along the exterior, in order to prevent tampering or damage to the cable.

To limit the power transferred by cable 54 through the hose 18 to an intrinsically safe level, the present invention utilizes intrinsically safe circuit barriers. As shown in FIG. 4, in a first line 55 of the cable 54, which preferably provides a 24 volt DC power supply to the driver circuit 52, a zener diode barrier 57 is utilized to prevent the voltage level in the line from exceeding 26 volts. The zener barrier 57 preferably includes three zener diodes 56 connected in parallel to provide three fault protection. The barrier 57 also includes a current limiting resistor 58 and a fuse 60. Fuse 60 assures that the voltage differential between the zeners 56 and power supply line 55 remains low to ensure intrinsic safety. In the enable pulse line 62, extending between the sensor 46 and driver circuit 52 an intrinsic safety barrier is also provided in the form of an optoisolator 64. The optoisolator 64 operates in a conventional manner to prevent the enable pulse from exceeding approximately 12 volts.

Figure 5:
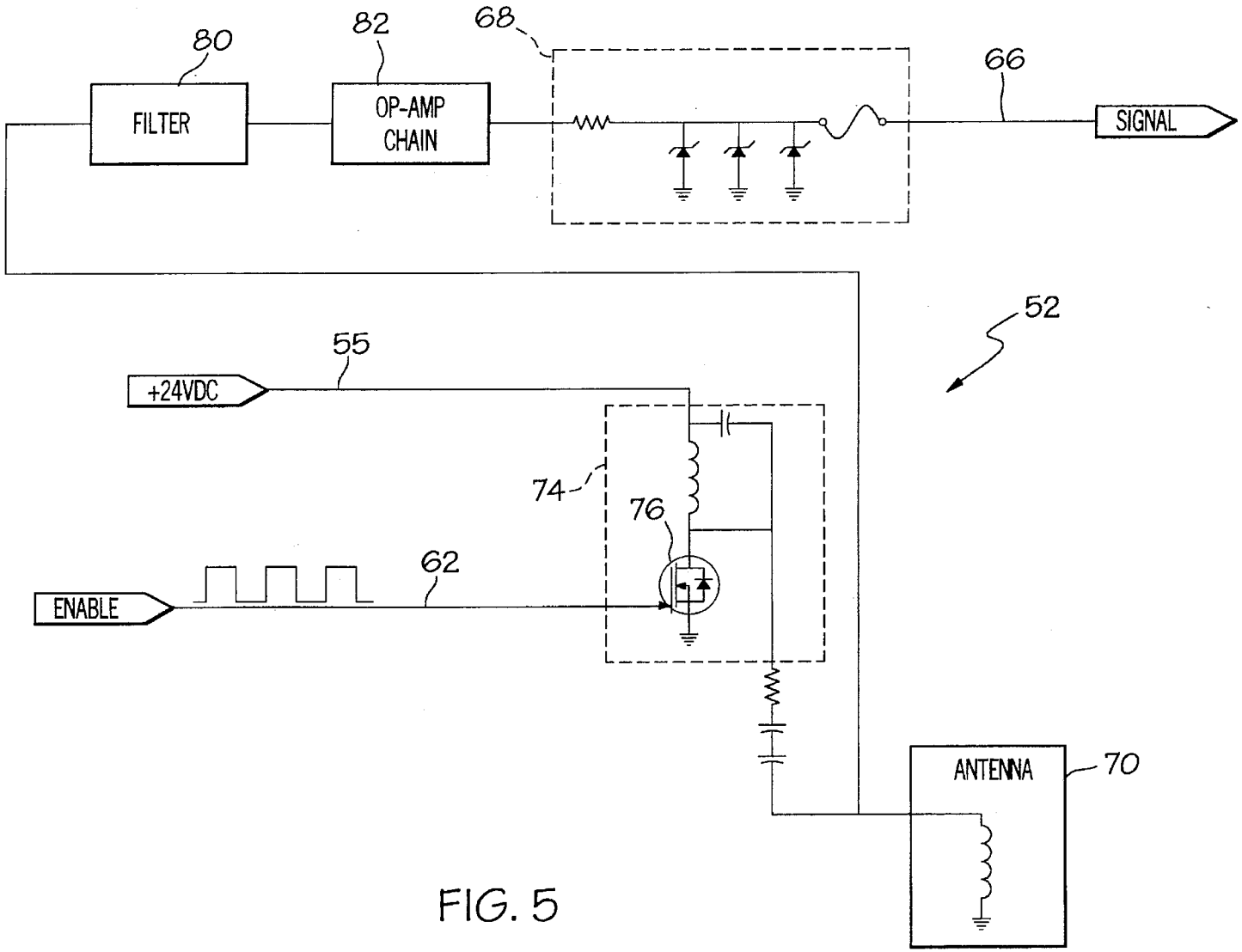
FIG. 5 is a partial schematic and partial block diagram of the driver circuit of FIG. 3.

In addition to the pulse and power lines, cable 54 also includes a ground connection and a return signal line 66. Signal line 66 transmits identification signals received from the vehicle 16 to the sensor 46 and ultimately to the microcontroller 42. As shown in FIG. 5, signal line 66 also preferably includes an intrinsic safety barrier in the form of a set of zener diodes 68 for limiting the potential of the signal line in the fuel hose 18. Barrier 68 preferably includes three zener diodes, which are preferably of the low capacitance type, connected in parallel and a fuse to limit the return signal voltage that is transmitted between the nozzle and dispenser as well as a current limiting resister. While the embodiment in FIG. 5 depicts a zener barrier, it is also possible to use a transformer as an intrinsic safety barrier without departing from the scope of the invention. While the system has been described with respect to specific examples of intrinsic safety barriers, it should be understood that the intrinsic safety barriers could comprise any combination of resistors, fuses, zener diodes, transorbs, transformers or optoisolators, depending on the particular application, provided the combination provides intrinsic safe power between the controller circuit 40 and the driver circuit 52.

FIG. 5 depicts the driver circuit 52 and the cable connections of the present invention in greater detail. As mentioned above, the driver circuit 52 is potted within the protective annular housing 34 to provide an additional intrinsic safety barrier. Encapsulation of the circuit prevents air gaps from forming and causing sparking and prevents energy from being transmitted from the circuit to create sparks. As shown in FIG. 5, the driver circuit 52 includes an antenna 70 for broadcasting an interrogation signal. Antenna 70 preferably consists of a wound wire coil which extends circumferentially about the interior of housing 34 such that the antenna surrounds the nozzle spout 28. The number of windings in the antenna 70 is preferably selected to provide a broadcast frequency of approximately 148kHz. Driver circuit 52 also includes a power oscillator or tank circuit, generally designated as 74, to power the antenna 70. Utilizing tank circuit 74, which preferably generates and stores a voltage of up to approximately 600 volts, enables the driver circuit 52 to generate a high power signal for antenna 70 from the low power, intrinsically safe signal transmitted through the fuel hose 18. Upon receipt of an enable pulse from sensor 46, MOSFET 76 is switched on, to release a power burst of up to approximately 600 volts from the tank circuit 74. This power burst energizes the antenna 70 to create a magnetic field. This field is broadcast by antenna 70 as an interrogation signal.

Figure 6:
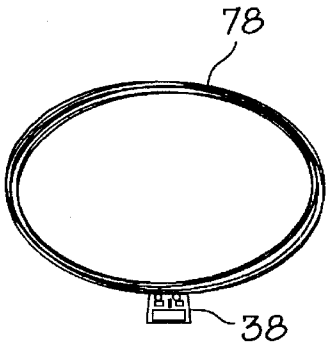
FIG. 6 is a perspective view showing an embodiment of the transponder of the present invention.

If a vehicle with an attached transponder 38 is located within the broadcast range of the antenna 70, the interrogation signal will charge the transponder via the transponder antenna 78 to generate an identification signal. The transponder 38 and antenna 78 are shown in FIG. 6. In the preferred embodiment, transponder 38 is formed of a commercially available transponder printed circuit board sold by Telsot, as Part No. 710-0036-00. Antenna 78 is preferably a wound wire coil having a diameter sized to fit on the vehicle fill pipe 30 and a number of windings to provide a broadcast frequency of 38kHz. In addition, the antenna 78 preferably has a planar configuration as shown in FIG. 6, to enable the antenna to detect the field from the nozzle antenna 70 anytime the transponder 38 is within the field range of the antenna 70, regardless of the vehicle orientation at the dispenser. The circumferential disposition of the antenna 78 about the spout 28 and of the antenna 78 about the fill pipe 30 advantageously insures that these antennas will read the generated electromagnetic fields irrespective of the relative angular positioning of housings 34 and 36.

Upon activation by the interrogation signal, the transponder circuit accesses identification codes fixedly stored for the vehicle in a memory area of the transponder in a known manner. These identification codes identify, among other features, the vehicle's fuel requirements and the types of environmental equipment, if any, that are attached to the vehicle. In a preferred embodiment of the invention, the transponder 38 detects the interrogation signal and is activated to retrieve the vehicle identification codes when the nozzle antenna 70 is within a six inch radius of the transponder 38. Thus, the driver circuit 52 may interrogate the transponder 38 and receive a return identification signal when the nozzle 20 is placed into the fill pipe 30 for fueling.

Upon accessing the vehicle identification codes, the transponder 38 utilizes the codes to modulate an RF oscillation signal. This signal is broadcast by the transponder antenna 78, and received by antenna 70 in the driver circuit 52 which is set to the broadcast frequency of the transponder 38.

The identification signal from the transponder 38 is passed through a conventional 38 kHz bandpass filter and a 148 kHz trap, as well as an operational amplifier chain 82 in the driver circuit 52 to filter out the 148 KHz power burst energy component from the identification signal. The identification signal is then transmitted to the controller 40, through the fuel hose 18 and the intrinsically safe zener barrier 68. Microcontroller 42 processes the identification signal to obtain information about the vehicle 16, such as fuel requirements and whether an onboard canister is present. Based upon this information, the microcontroller 42 transmits control signals via the optocoupler 44 to either enable or disable the dispenser vapor recovery system, and to disable the dispenser if the fuel type does not match that required by the vehicle.

Figure 8:
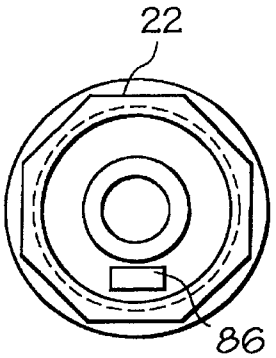
FIG. 8 is an end view of the nozzle of FIG. 2 taken along line 8—8.

In order to complete the connection between the controller 40 and the driver circuit 52 at the fuel hose and nozzle junction, a brush block 86, as shown in FIG. 8, is included in the nozzle adaptor 22. Brush block 86 contacts an electrical connection in the fuel hose 18 when the nozzle adapter 22 is assembled onto the hose 18 to complete the circuit. Brush block 86 enables the low power signals to be transmitted through the hose 18 throughout a 360 degree rotation of these components. It also permits the nozzle 20 to be disconnected from the hose for maintenance or replacement.

Thus, according to the present invention, during the pulse period for a dispenser 12, the dispenser sensor 46 is enabled to transmit a pulse to the driver circuit 52 on the nozzle 20, which responds by broadcasting an interrogation signal. If a vehicle is located at the dispenser and has attached to it a transponder that is within the broadcast range of the nozzle antenna, the vehicle transponder will respond with a signal containing identification codes for the vehicle. The identification signal will be transmitted to the microcontroller, which will then issue control signals to the dispenser 12 to properly configure the operative mechanisms of the dispensers that are appropriate for the vehicle, and will proceed at the end of the period to generate another pulse to repeat the process for the next dispenser. In the preferred embodiment of the invention, the exemplary operative mechanisms of the dispenser to be configured are components to select the appropriate fuel for an identified vehicle and/or to activate or deactivate a pump for a vapor recovery system. However, other types of dispenser configurations are possible and are within the scope of the invention.

The present invention is advantageous in that a tank circuit is provided on a nozzle spout to generate a high power broadcast signal from a low power signal transmitted from the dispenser. Since the high power signal is maintained in a potted housing on the nozzle, and is not intermixed with the fuel and vapors in the fuel hose, the present invention is intrinsically safe, and thus can be used in a flammable environment, such as a refueling station, without risk of sparking or fire. Further, since the interrogation signal is broadcast from the nozzle spout, the interrogation signal is able to activate a vehicle transponder whenever the nozzle is placed adjacent to a transponder, regardless of where the vehicle is parked at the dispenser.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An identification and control system for a vehicle refueling station, comprising:

at least one fuel dispenser;

a fuel nozzle connected to each dispenser by a fuel hose, said nozzle including a nozzle spout adapted to be disposed in a fill pipe of a vehicle;

a first control circuit associated with said at lease one dispenser for generating a first power signal;

a second control circuit disposed in a protective housing on each nozzle, and electrically connected to the first control circuit in an intrinsically safe manner along the fuel hose, the first power signal being transmitted to the second control circuit through the intrinsically safe connection, the second control circuit adapted to generate and store a second power signal from the first power signal, the second power signal being of substantially higher power than the first power signal;

an antenna associated with the second control circuit for generating an electromagnetic signal from the second power signal;

a transponder disposed in proximity to the vehicle fill pipe for generating an identification signal corresponding to said vehicle in response to said electromagnetic signal; and a receiver associated with the antenna for detecting the identification signal and using the identification signal to control the dispenser.

2. An identification and control system as recited in claim 1 further including a switching device, associated With the second control circuit, for releasing the stored second power signal, the switching device releasing the stored second power signal in response to an interrogation pulse from the first control circuit.

3. An identification and control system as recited in claim 2 wherein the interrogation pulse is generated periodically by the first control circuit.

4. An identification and control system as recited in claim 1 wherein the connection between said first and second control circuits includes at least one power limiting circuit component.

5. An identification and control system as recited in claim 4 wherein the power limiting components include at least one zener diode.

6. An identification and control system as recited in claim 1 wherein the second control circuit includes a power oscillator for generating and storing the second power signal.

7. A vehicle identification system adapted for use with a fuel dispenser for refueling a vehicle, said dispenser having at least one fuel nozzle associated therewith and attached to the dispenser by a fuel hose, said system comprising:

a first control circuit associated with the dispenser for generating a first power signal of relatively low power;

a second control circuit located in a protective housing on the fuel nozzle and electrically connected to the first control circuit through an intrinsically safe connection along the fuel hose, the second control circuit including circuit components for generating and storing a second power signal, the second power signal being of substantially higher power than the first power signal;

a pulse generating circuit associated with the first control circuit, the pulse generating circuit being operative to transmit a periodic enable pulse through the fuel hose to the second control circuit;

a switching device associated with the second control circuit for releasing the stored second power signal in response to the enable pulse;

an antenna associated with the second control circuit for broadcasting an electromagnetic signal from the released second power signal;

a transponder disposed on said vehicle for receiving said electromagnetic signal and transmitting a responsive identification signal; and a receiver for detecting the identification signal and controlling the dispenser in accordance with the identification signal.

8. The system of claim 7 wherein the dispenser includes a vapor recovery system which is controlled based upon the identification signal.

9. The system of claim 7 wherein said system includes a control device for selecting a dispenser fuel in response to the identification signal.

10. A vehicle identification system adapted, for use with one or more fuel dispensers for refueling vehicles, each of the dispensers having at least one fuel nozzle associated therewith and attached to the dispenser by a fuel hose, the system comprising:

a first circuit located in each dispenser for generating a first power signal;

a second circuit disposed on each fuel nozzle;

an intrinsically safe circuit connection between the first and second circuits, the intrinsically safe circuit connection including at least one power limiting circuit component, the first power signal being transmitted to the second circuit through the intrinsically safe circuit connection such that power from the first power signal is stored in the second circuit, the second circuit using the stored power to generate a second power signal;

an antenna associated with the second circuit for generating an electromagnetic signal from the stored second power signal; and an identifying device associated with a vehicle for generating an identification signal in response to the electromagnetic signal.

11. A vehicle identification system as recited in claim 10 wherein the electromagnetic signal is generated in response to an interrogation signal.

12. A vehicle identification system as recited in claim 11 wherein the first circuit includes a pulse generating circuit for generating the interrogation signal.

13. A vehicle identification system as recited in claim 12 further comprising additional intrinsically safe circuit connections between the first and second circuits for transmitting an interrogation signal and return identification signal.

14. A vehicle identification system as recited in claim 13 wherein the second intrinsically safe circuit connection includes at least one power limiting circuit component.

15. A vehicle identification system as recited in claim 14 wherein the at least one power limiting component is selected from amongst the group consisting of zener diodes, optoisolators, transformers, resistors and transzorbs.

16. A vehicle identification system as recited in claim 10 wherein the at least one power limiting circuit component includes a zener diode.

* * * * *